United States Patent [19]

Cherry et al.

[11] Patent Number: 4,752,252

[45] Date of Patent: Jun. 21, 1988

[54] AXIAL GRIP CONNECTOR HAVING ECCENTRIC JAWS

[75] Inventors: Hitesh Cherry, Harrisburg; Walter M. Werner, Downingtown, both of Pa.

[73] Assignee: AMP Incorporated, Harrisburg, Pa.

[21] Appl. No.: 93,079

[22] Filed: Aug. 28, 1987

Related U.S. Application Data

[63] Continuation of Ser. No. 913,185, Sep. 29, 1986, abandoned.

[51] Int. Cl.[4] ..... H01R 4/38

[52] U.S. Cl. ..... 439/784; 439/807

[58] Field of Search ..... 285/178, 323; 439/784, 439/805, 807, 863

[56] References Cited

U.S. PATENT DOCUMENTS

| | | | |
|---|---|---|---|
| 2,261,414 | 11/1941 | Rogoff | 339/268 S |
| 3,041,575 | 6/1962 | Schneider | 339/268 R |
| 3,444,505 | 5/1969 | Becker | 339/268 R |
| 4,408,926 | 10/1983 | Werner | 403/310 |
| 4,508,409 | 4/1985 | Cherry et al. | 339/97 R |

*Primary Examiner*—Gil Weidenfeld
*Assistant Examiner*—Gary F. Paumen
*Attorney, Agent, or Firm*—Allan B. Osborne

[57] ABSTRACT

An axial grip connector for electrically and mechanically connecting cables together. More particularly, the connector includes a plurality of beveled, jaws which cooperatively form an elongated, double tapered gripping member with a passage therethrough for receiving the cables, collars for being driven onto the tapered gripping member to compress the jaws into gripping engagement with the cables and telescoping drive members which enclose the gripping member and collars and which drive the collars onto the gripping member by being threaded together.

7 Claims, 4 Drawing Sheets

AXIAL GRIP CONNECTOR HAVING ECCENTRIC JAWS

This application is a continuation of application Ser. No. 913,185 filed 9-29-86, now abandoned.

FIELD OF THE INVENTION

The invention disclosed herein relates to connectors for electrically and mechanically connecting cables by application of a compressive force created by the action of a straight line motion on a body having a tapered surface.

BACKGROUND OF THE INVENTION

Axial grip connectors are known from U.S. Pat. Nos. 4,408,926 and 4,508,409. In each of these disclosures, electrical cables are mechanically gripped by compressing a tapered gripping member, formed from two or more jaws, down around the cables. The compressive force is provided by linearly moving collars, having complementary tapered passages, onto the gripping member by the use of specialized tools such as the hydraulically operated tool shown in U.S. Pat. No. 4,408,926. Whereas, the disclosed axial grip connectors have met tensile and other tests required by industry, the tools needed to drive the collars onto the gripping memeber are not of the type normally found in the lineman's tool bag.

It is, therefore, desirable to provide an axial grip connector which can connect the ends of two cables using simple hand tools such as wrenches.

SUMMARY OF THE INVENTION

According to the invention, an axial grip connector is provided which includes a plurality of elongated jaws, each having an inner surface and an outer surface which is beveled outwardly from adjacent the midpoint towards each end. The jaws cooperatively form a double tapered gripping member with the inner surfaces of the jaws forming a passage therethrough to receive cable being connected. Collars having tapered passages are provided to be driven onto each end of the gripping member to compress the jaws into gripping relation with the cables. The collars and gripping member are housed within male and female drive members which drive the collars by being threaded together using wrenches and the like.

DESCRIPTION OF THE INVENTION

Figure 1:
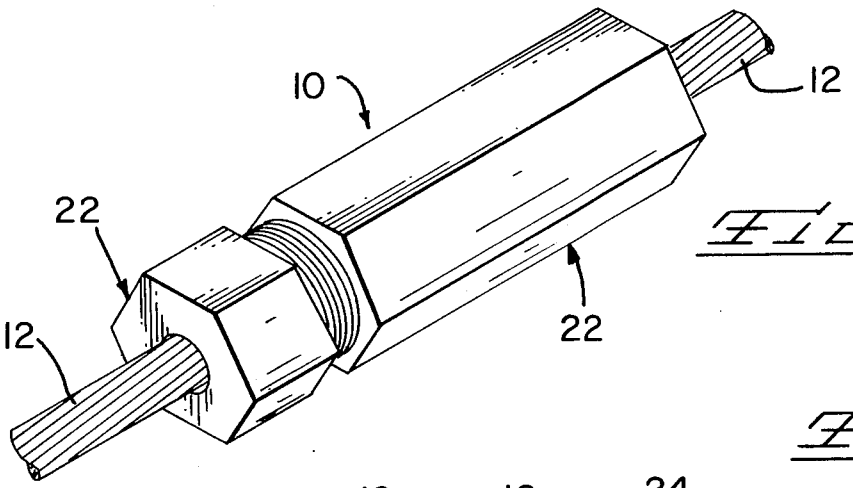
FIG. 1 is a perspective view of the connector constructed in accordance with the preferred embodiment of the invention disclosed herein.

Axial grip connector 10 as shown in FIG. 1 is used to electrically and mechanically connect the ends of lengths of cables 12 together. Connector 10 could, however, be modified (not shown) to connect one end of a cable 12 to a structure; e.g., a high tension tower (not shown).

Figure 2:
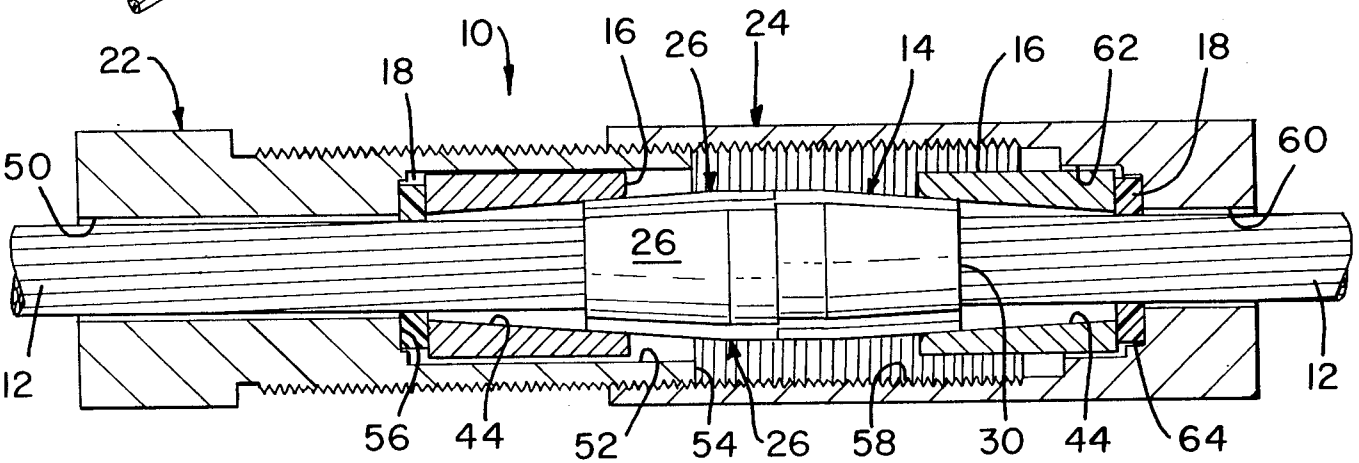
FIG. 2 is a cross-sectional view of the connector.

As shown generally in FIG. 2, connector 10 comprises a double tapered, elongated gripping member 14, sliding drive collars 16, washers 18, compressible spacer 20 (shown in FIG. 3), male drive member 22 and female drive member 24. The drawings depicts connector 10 with cables 12 in place but prior to cables 12 being mechanically secured therein. With the exception of spacer 20, the components of connector 10 are preferrably made from aircraft-type, 6061-T-6 aluminum.

Figure 3:
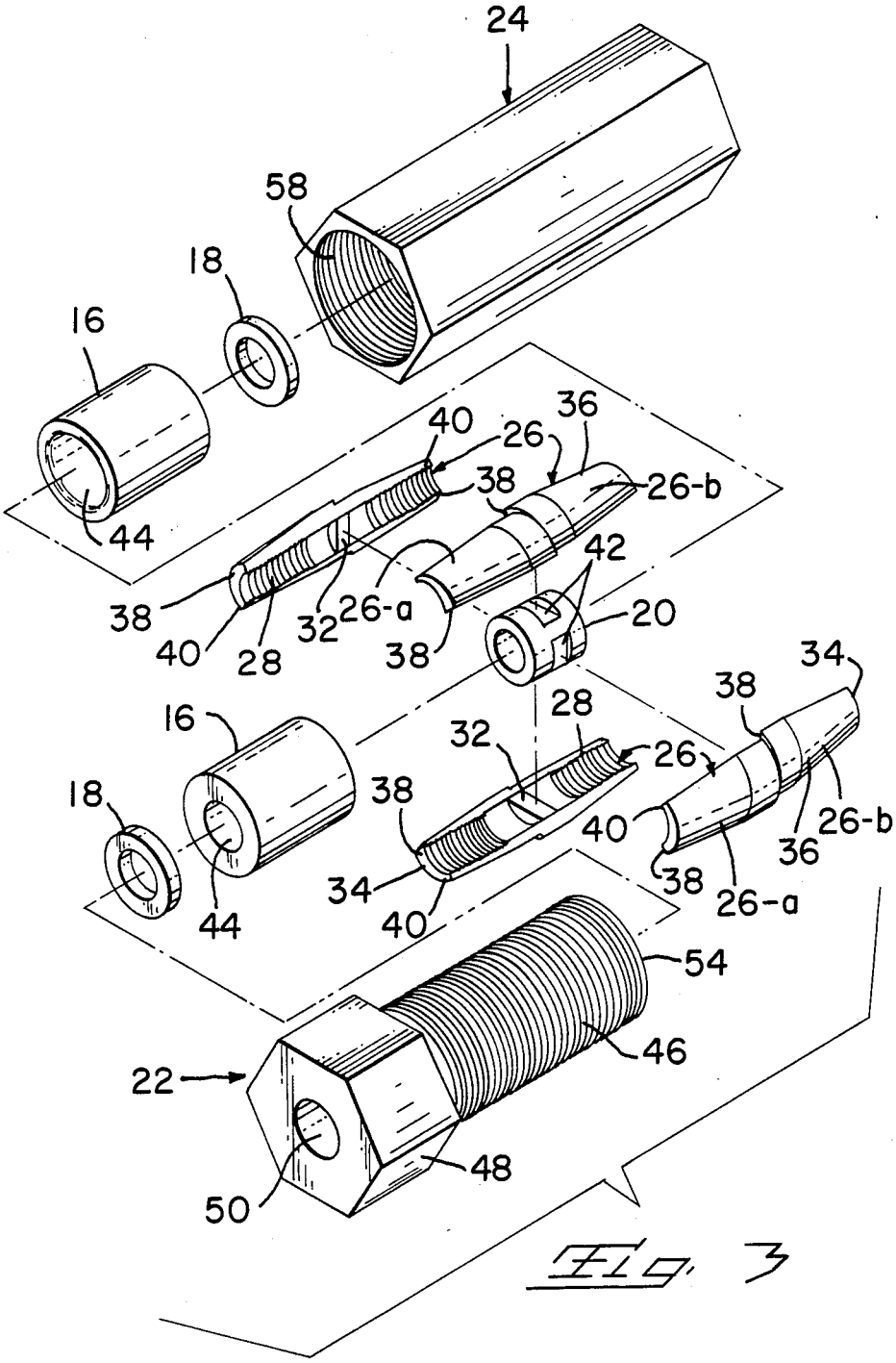
FIG. 3 is an exploded, perspective view of the connector.

With reference to both FIGS. 2 and 3, the four jaws 26, arcuate-shaped in the plane normal to their axis, are made so that upon being assembled together, they collectively form the aforementioned elongated gripping member 14 with serrated inner surface 28 on each jaw 26 collectively defining passage 30 therethrough. Transverse wall 32 is provided on inner surface 28 of each jaw 26 intermediate ends 34. Outer surfaces 36 are beveled in both directions to provide member 14 with a double taper. Further, the thickness of each half, **26-*a*, 26-*b*, of each jaw 26 thins in a direction normal to the jaw axis and with the thinning of jaw half 26-*a* being in an opposite direction relative to the thinning of jaw half 26-*b*. The thick side of each half 26-*a*, 26-*b*, is indicated by reference numeral 38 and the thin side is indicated by reference numeral 40. The thinning in opposite directions makes each half 26-*a*, 26-*b*, eccentric to each other. However, jaws 26** could be made without being eccentric such as disclosed in U.S. Pat. No. 4,408,926 which is incorporated herein by reference.

Compressible spacer 20 includes four notches 42 spaced evenly around the outer circumference. In assembling gripping member 14, jaws 26 are placed around spacer 20 with transverse walls 32 being received in notches 42 to hold jaws 26 in position. Spacer 20 is preferrably made from a suitable material such as polyethylene, which is readily compressible.

Drive collars 16 are cylindrical with a tapered passage 44 therethrough. The degree of taper complements the tapers on gripping member 14.

Washers 18 are preferrably anodized and TFE - impregnated.

Male drive member 22 includes a 46-48 threaded portion 46 and hexagonal head 48. As shown in FIG. 2, passage 50 extends through drive member 22 with a first concentric counterbore 52 being provided in end 54. A second, smaller counterbore 56 is provided in the floor of counterbore 52. Drive member 22 is also anodized and TFE - impregnated.

Female drive member 24 has a hexagonal outer surface and is cup-shaped to define threaded aperture 58. As shown in FIG. 2, passage 60 extends through drive member 24, intersecting aperture 58 and is concentric therewith and with first and a smaller, second counterbores 62, 64 respectively.

Figure 4:
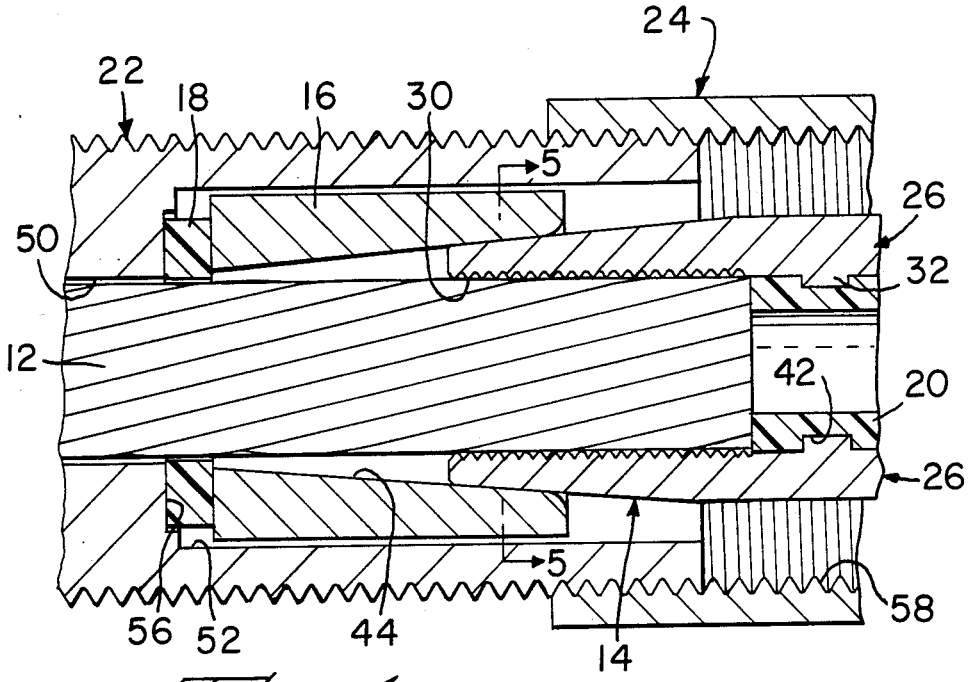
FIGS. 4 and 5 are respectively side and cross-sectional views of one end of the connector with a cable therein preparatory to being mechanically gripped.

As noted above, gripping member 14 is formed by placing jaws 26 around spacer 20. Drive collars 16 are placed by hand on each end of member 14, as shown in FIGS. 2 and 4, to hold jaws 26 in place. With washers 18 seated in second counterbores 56 and 64 in drive members 22, 24 respectively, the two drive members 22, 24 are threaded together just far enough to keep the components together until use. As shown in FIG. 2, collars 16 are seated in first counterbores 52, 62 of respective drive members 22, 24.

Figure 5:
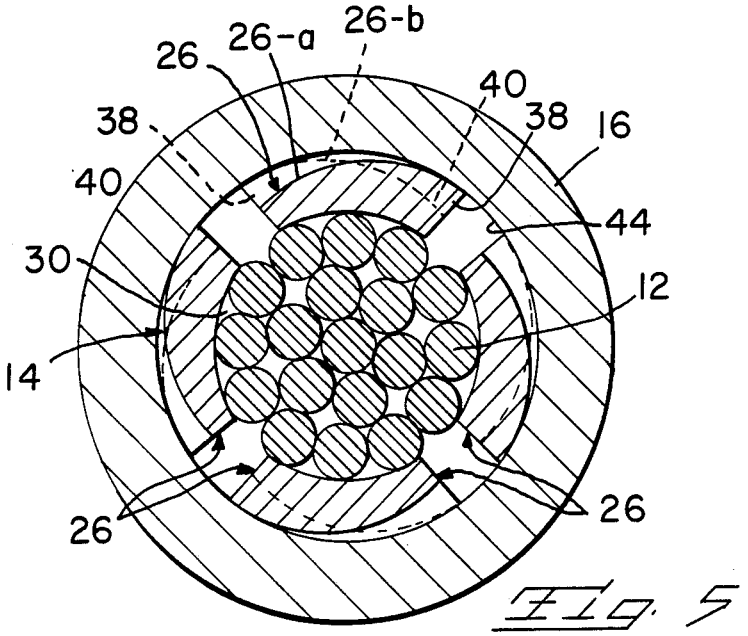

Cables 12, with insulating jackets (not shown) removed, are inserted into the ends of the abovedescribed, loosely assembled connector 10 until they abut spacer 20, as shown in FIG. 4, so that the ends of cable 12 are in serrated passage 30 of gripping member 14. FIG. 5 illustrates the positioning of the aforementioned eccentric jaw halves **26-*a*, 26-*b*** with the latter being indicated in phantom.

Figure 6:
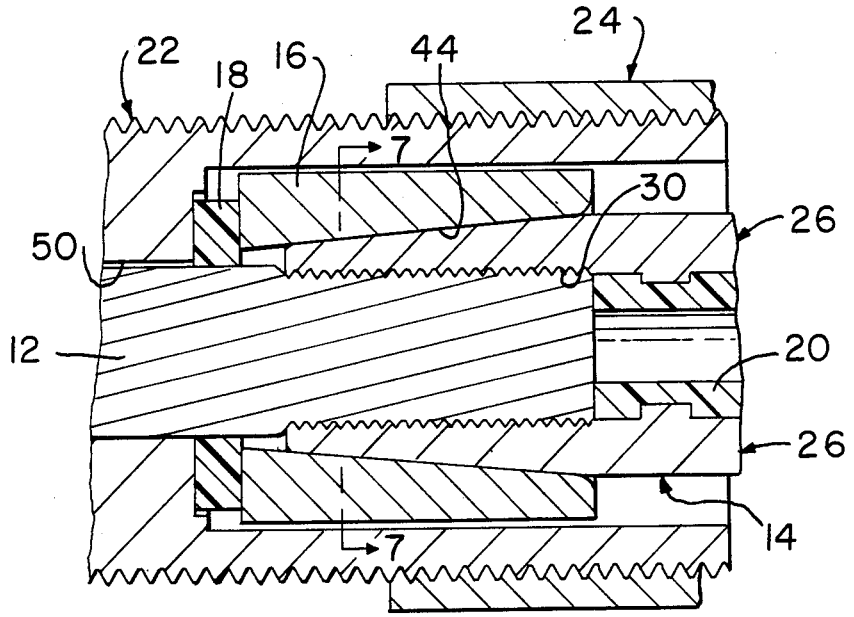
FIGS. 6 and 7 are respectively side and cross-sectional views of one end of the connector after the cable therein has been mechanically gripped.
Figure 7:
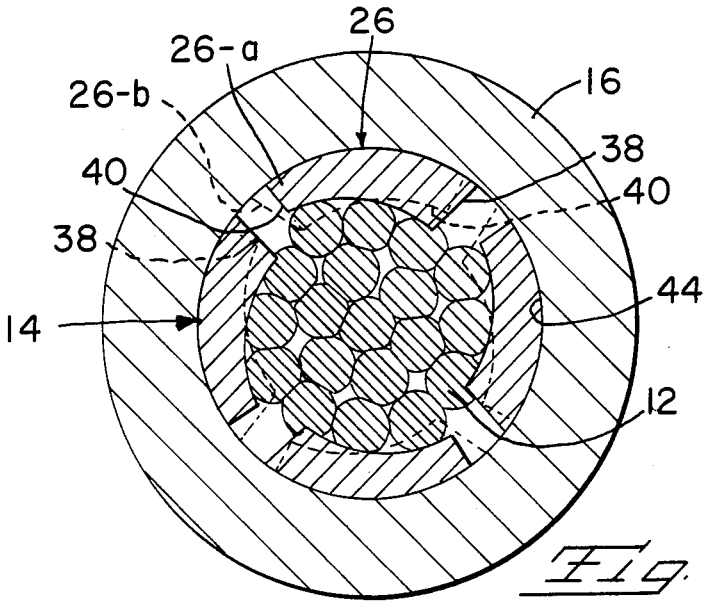

Securing cables 12 in connector 10 is accomplished by threading drive members 22, 24 together to drive collars 16 further onto both ends of gripping member 14 to compress jaws 26 of member 14 around cables 12 in passage 30 as shown in FIGS. 6 and 7. Simple hand tools such as wrenches are used to thread members 22, 24 together.

As collars 16 are being driven, in a linear direction by the rotating drive members 22, 24, the frictional engagement therebetween tends to cause collars 16 to rotate also. If this occurs, cables 12 will wind up. Then, subsequent to making the connections, cables 12 tend to unwind which would reduce their diameters and cause a decrease in the compressive force being exerted against them by gripping member 14.

One way to prevent cable wind-up is to prevent collars 16 from rotating. This is accomplished by the use of eccentric jaws 26. Rotation is substantially prevented by the eccentric outer surfaces 36 trying to force collars 16 into an eccentric rotational path which they cannot do because of being confined within counterbores 52, 62 of drive members 22, 24 respectively. Accordingly, collars 16 substantially remain rotationally stationary until sufficient force builds up to cam them over the eccentric outer surfaces 36 after which they again are rotationally stationary.

As can be discerned, an axial grip connector for electrically and mechanically joining ends of helically-wound cables has been disclosed. The connector includes a double tapered gripping member formed from several jaws. Collars having tapered passages are driven onto the gripping member to force the jaws into compressive gripping engagement with cables inserted into the member from each end. The collars are driven by threading together telescoping male and female drive members in which the gripping member and collars are positioned. Simple hand tools such as wrenches are used to draw the two drive members together. Further disclosed are eccentric-shaped jaws which prevent the collars from being rotated by the rotating drive members.

We claim:

1. An axial grip connector for connecting two, end to end cables, said connector comprising;

a plurality of elongated conductive jaws, each having a channel-shaped inner surface and an outer surface which converges towards said inner surface from about a middle area of said jaw towards each end and further converges towards said inner surface normally to the longitudinal axis on each longitudinal side of said middle area with said normal convergence on one said side of said middle area being in an opposite direction relative to said normal convergence on the other said side of said middle area, said plurality of jaws forming, in cooperation with each other, an elongated gripping member having a passage therethrough for receiving a cable in each end, an outer circumference which is tapered toward respective longitudinal ends and having anti-rotational means thereon comprising off-sets between adjacent jaws formed by said normal convergence;

collars having tapered surfaces complementary to the tapered circumference of said gripping member, said collars being slidingly disposed on said respective ends of said gripping member; and female and male drive members having in cooperation with each other a longitudinal space for receiving said gripping member with said collars thereon and openings to said space from respective ends through which cables may be inserted for receipt into said passage in said gripping member, said drive members adapted to be telescoped together to drive said collars towards each other to compress said gripping member around the cables which may be in said passage.

2. An axial grip connector for electrically and mechanically connecting cables together, comprising;

a plurality of elongated, conductive jaw means, each being arcuate-shaped in a plane normal to their axis and defining an arc of less than 360 degrees, each said jaw means having channel means on an inner surface and being beveled on an outer surface from adjacent the midpoint of said jaw means outwardly towards both ends, said plurality of jaw means forming, in cooperation with each other, an elongated gripping member having an outer surface which converges from the middle towards each end thereof and with said channel means cooperating to form a passage therethrough for receiving the cables therein, said jaw means further being eccentric with said eccentricity being provided by a uniform decrease in the thickness across the width of each longitudinal half of each jaw means with the direction of decreasing thickness being opposite in one half relative to the other half and further, with the decreasing thickness being reflected only in said outer surface;

collar means having tapered passage means for being placed on said tapered outer surface at each end of said gripping member; and telescoping drive means enclosing said gripping member with said collar means thereon, said drive means being adapted to drive said collar means further into said gripping member by being threaded together whereby said gripping member is compressed around the cables in gripping engagement therewith.

3. The axial grip connector of claim 2 wherein said drive means include male and female members having passages for receiving said gripping member and said collar means and for receiving the cables inserted in said gripping member.

4. The axial grip connector of claim 3 wherein said passages in said male and female members include counterbores for receiving said collar means.

5. The axial grip connector of claim 4 further including second counterbores in said passages for receiving washer means which are adapted for being placed between said collar means and respective said male and female members.

6. The axial grip connector of claim 5 wherein said male and female members include tool receiving outer surfaces for rotating said members together and apart.

7. Anti-rotational means for an axial grip connector of the type having a plurality of elongated jaws which cooperate to form an elongated gripping member having a tapered outer surface extending towards both ends from the mid portion, said member being compressible around cables inserted into each end of a passage exending therethrough by collars being driven onto the member from opposite ends, said anti-rotational means comprising eccentricity in said jaws with said eccentricity being provided by a uniform decrease in the thickness across the width of each longitudinal half of each jaw with the direction of decreasing thickness being opposite in one half relative to the other half and with the decreasing thickness being reflected only in the outer surface thereof.

* * * * *